US006791250B2

(12) United States Patent
Jurkovic et al.

(10) Patent No.: US 6,791,250 B2
(45) Date of Patent: Sep. 14, 2004

(54) SEAL AND FLAG ASSEMBLY FOR LAMP BASE SIDEWIRE WELDING

(75) Inventors: Paul J. Jurkovic, Painesville, OH (US); Harold D. Myers, Jr., Madison, OH (US); David A. Westenfelder, II, Mantua, OH (US)

(73) Assignee: Eye Lighting International, Mentor, OH (US)

( * ) Notice: Subject to any disclaimer, the term of this patent is extended or adjusted under 35 U.S.C. 154(b) by 87 days.

(21) Appl. No.: 10/278,569

(22) Filed: Oct. 23, 2002

(65) Prior Publication Data

US 2004/0080253 A1 Apr. 29, 2004

(51) Int. Cl.[7] ..... H01J 5/50

(52) U.S. Cl. ..... 313/318.09; 313/318.04; 429/615

(58) Field of Search ..... 313/318.01–318.1, 313/318.12, 25, 623, 624, 625, 626; 439/615, 611

(56) References Cited

U.S. PATENT DOCUMENTS

| | | | | |
|---|---|---|---|---|
| 3,573,534 A | | 4/1971 | Leighton | |
| 3,763,390 A | | 10/1973 | Belknap | |
| 3,778,663 A | | 12/1973 | Beeson et al. | |
| 3,885,186 A | | 5/1975 | Vause | |
| 4,366,408 A | | 12/1982 | Cooper et al. | |
| 4,489,252 A | | 12/1984 | Eckhardt | |
| 5,032,759 A | | 7/1991 | Thiry et al. | |
| 5,039,905 A | | 8/1991 | Essers et al. | |
| 5,218,261 A | | 6/1993 | Stark | |
| 5,241,238 A | * | 8/1993 | Westlund et al. | 313/25 |
| 5,453,655 A | | 9/1995 | Helbig et al. | |
| 5,521,460 A | * | 5/1996 | Zhu | 313/318.09 |
| 5,627,428 A | | 5/1997 | Helbig et al. | |
| 5,757,133 A | | 5/1998 | Meyer et al. | |
| 5,936,333 A | | 8/1999 | Scherzer | |
| 5,986,404 A | | 11/1999 | Dietze | |
| 6,268,696 B1 | | 7/2001 | Dolan et al. | |
| 6,313,582 B1 | | 11/2001 | Miyanaga et al. | |
| 6,323,588 B1 | * | 11/2001 | Lilljedahl et al. | 313/318.1 |
| 6,346,767 B1 | | 2/2002 | Swadel et al. | 313/318.01 |
| 6,469,427 B1 | * | 10/2002 | Itaya et al. | 313/318.04 |
| 6,482,061 B1 | * | 11/2002 | Matsuba et al. | 445/23 |

FOREIGN PATENT DOCUMENTS

| | | |
|---|---|---|
| JP | 52042678 | 4/1977 |

* cited by examiner

*Primary Examiner*—Nimeshkumar D. Patel
*Assistant Examiner*—Karabi Guharay
(74) *Attorney, Agent, or Firm*—Howard M. Cohn; Derry Stauffer

(57) ABSTRACT

A lamp assembly and a method for securing a base on the lamp that electrically connect a side lead wire to the base shell and that also secure the base to the lamp without using either solder or adhesive. Welding efficiency is optimized for the side lead wire to base shell connection. A metal screw base having base screw threads is screwed onto an outer jacket having a threaded seal with seal screw threads and with at least one lead wire extending out of a bottom of the seal being electrically and mechanically connected to a flag assembly being at least a wire in a close-fitted electrically nonconductive sleeve. A groove is formed across the seal screw threads, the groove being dimensioned to closely fit around the flag assembly; and the flag assembly being positioned in the groove such that an inner end of the flag assembly is electrically connected to the lead wire, and an outer, flag, end of the flag assembly is bent over a lip of the base and welded to an outside surface of the base, with the weld preferably being near to the lip.

29 Claims, 4 Drawing Sheets

SEAL AND FLAG ASSEMBLY FOR LAMP BASE SIDEWIRE WELDING

TECHNICAL FIELD OF THE INVENTION

The present invention relates to attaching a wire to the shell of a base on an electric lamp and, more particularly, to an assembly that enables the wire to be welded to the base in a way that prevents undesirable movement of the base relative to the lamp.

BACKGROUND OF THE INVENTION

The present invention relates generally to assembly of an electric lamp (i.e., a light bulb which is known in the art as a "lamp"—the "bulb" is only the outer glass envelope). In particular, the invention concerns both a means for attaching a wire to the shell of a base on the lamp, and also to a means of securing the base on the lamp. Typically, the base is attached to the neck of a "sealed lamp" wherein one of the electrical "lead wires" (a sidewire) is trapped between the bulb neck and the base, and then the sidewire is electrically connected to the side of the base. Historically, the electrical attachment is by means of soldering, but there is now a big push to avoid the use of lead (a primary component in most solders) for environmental reasons. Lamp makers have implemented various means for welding the sidewire instead of soldering, but there are many problems associated with sidewire welding. For example, heat generated in the welding process can cause damage to the glass bulb that may lead to premature lamp failure. Also, the average weld quality and amount of variation in the weld quality depend on the materials used in the welded parts, the dimensions of the welded parts, the positioning of the welded parts, and many other factors known in the welding arts.

A further set of problems is raised when sidewire welding is substituted for soldering in lamps that involve high temperature use, for example in lamps generally known as High Intensity Discharge (HID) lamps. Because of high lamp operating temperatures, basing cement is typically not used to secure the base onto the bulb; rather screw threads can be formed in the glass neck of the bulb (forming a "threaded seal") upon which the base can be screwed onto the lamp. This is a well known process in the lamp making industry. Typically, a vertical groove is formed across the screw threads in the glass neck to provide a recess for the sidewire to lie in. Once the base is screwed on, the groove can be filled with molten solder to electrically attach the wire (in the groove) to the base shell where it passes over the groove. Once it hardens, the solder serves a desired additional purpose of locking the base in position so that it cannot be unscrewed off of the lamp. If the solder fills the groove properly, the base will not be able to move more than a degree or so relative to the bulb, and many lamp applications specify very tight limits on such movement. As a result, regulatory agencies such as ANSI (American National Standards Institute) and IEC (International Electrotechnical Commission) have published standards that require no more than a small number of degrees movement of the base relative to the bulb. When solder is replaced by welding for such lamps, new ways of securing the base to the bulb must be developed.

U.S. Pat. No. 6,346,767 (Swadel, et al.; 2002)—"Swadel"—discloses a lamp with a formed, cemented clip to secure base to lamp. The lamp's bottom portion (21) has threads (23) and a groove (25) ending in a deeper cavity (receiving port 25*a*). The side lead-in wire (34) is attached, as by welding, to a locking clip (10), and the wire-clip assembly lies in the groove such that a scyphate middle portion (16) of the clip is accepted by the receiving port. The base (32) is threaded onto the bottom threads (23) and an end portion (18) of the locking clip is welded to the base by bending the end portion over the top of the base in order to contact the outside surface of the base. An adhesive chemical attachment means (50) is located in the receiving port (25*a*) to chemically affix the locking clip (10) to the lamp end (21).

U.S. Pat. No. 5,032,759 (Thiry, et al.; 1991)—"Thiry"—discloses a lamp base (10) comprising a metal shell contact (14) containing a molded glass body (12) that has a cylindrical wall (18). The invention comprises thinning the wall (18) in an area behind the point (a weld zone 48) where a side lead (50) is to be welded to the exterior surface of the shell contact (14). The thinning is intended to deter slumping of the glass adjacent the weld zone. Thiry teaches (column 1, lines 34–49) that the existence of a gap between the glass and the shell causes welding problems due to allowed flexing of the shell when the lead is pressed against the shell by the welding tool. The welding problems are said to result in occurrences of weld failure in two to five percent of lamp production involving the subject type of base.

The Swadel patent avoids the use of solder, but does not address situations where high operating temperatures may negate the effectiveness of the adhesive used to secure the base to the lamp. The Thiry patent discloses problems that arise when resistance welding a wire to a base shell when there is a cavity with insufficient support for the shell. It is an objective of the present invention to solve these and other problems that arise when both electrically connecting a sidewire to a base and also securing the base to a lamp without using either solder or adhesive.

BRIEF SUMMARY OF THE INVENTION

According to the invention, a lamp assembly comprises a metal screw base having base screw threads; an outer jacket having a threaded seal wherein seal screw threads are formed in a neck portion of the outer jacket, such that the seal screw threads conform to the base screw threads to allow the base to be screwed onto the threaded seal; one or more lead wires extending out of a bottom of the threaded seal; a flag assembly comprising a wire in a close-fitted electrically nonconductive sleeve, the flag assembly having an outer end comprising a flag; a groove formed across the seal screw threads and dimensioned to closely fit around the flag assembly; and the flag assembly being positioned in the groove such that an inner end of the flag assembly is electrically connected to at least one of the one or more lead wires, and the flag of the flag assembly is bent over a lip of the screw base and welded to an outside surface of the screw base.

Further according to the invention, the lamp assembly is such that the wire of the flag assembly is at least one of the one or more lead wires.

Further according to the invention, the lamp assembly is such that the inner end of the flag assembly is electrically connected to at least one of the one or more lead wires by welding.

Further according to the invention, the lamp assembly is such that the flag comprises flat metal. Preferably, the flag is a separate piece of flat metal stock that is electrically and mechanically connected to the wire; and a shank portion of the flag assembly where the flat metal stock overlaps the wire is conformed to the shape of the wire and is covered by the sleeve. More preferably, the flag has a thickened portion that is positioned in the vicinity of a fold where the flag assembly is bent over the lip of the screw base; and the thickened portion traversingly extends to at least one of two lateral edges of the flag. Most preferably, the thickened portion comprises an extended end of the wire that is formed such that the extended end traverses a flat side of the flag. Further, the thickened portion extends under the sleeve enough to increase the magnitude of a sleeve covered flag thickness; and the thickened portion extends out to the fold such that the fold is able to bend around the outer end of the thickened portion.

Further according to the invention, the lamp assembly is such that the flag assembly is welded to the outside surface of the screw base by means of resistance welding.

Further according to the invention, the lamp assembly is such that the sleeve comprises a resilient, high temperature material.

According to the invention, a method for securing a base on a lamp comprises the steps of:

a) forming seal screw threads in a neck portion of the lamp such that the seal screw threads conform to base screw threads of the base;
b) providing a flag assembly comprising a wire in a close-fitted electrically nonconductive sleeve, the flag assembly having an outer end comprising a flag;
c) forming a groove across the seal screw threads wherein the groove is dimensioned to closely fit around the flag assembly;
d) positioning the flag assembly in the groove;
e) screwing the base onto the seal screw threads;
f) bending the flag over a lip of the base; and
g) welding the flag to an outside surface of the base.

According to the invention, the method further comprises the steps of: providing a flat metal portion for the flag, wherein at least a part of the flat metal portion is covered by the sleeve; providing the flat metal portion by electrically and mechanically connecting a piece of flat metal stock to the wire; for a shank portion of the flag assembly where the flat metal stock overlaps the wire, conforming the flat metal stock to the shape of the wire and covering the shank portion by the sleeve; providing a thickened portion on the flag; providing the thickened portion by extending the wire; and forming an extended end on the wire such that the extended end traverses a flat side of the flag and extends to at least one of two lateral edges of the flag.

According to the invention, the method further comprises the step of using resistance welding to weld the flag to the outside surface of the base.

According to the invention, the method further comprises the steps of: electrically connecting at least one of one or more lead wires of the lamp to the base by electrically connecting an inner end of the flag assembly to at least one of the one or more lead wires; and utilizing at least one 30*b* of the one or more lead wires as the wire of the flag assembly.

According to the invention, the method is such that the groove comprises a flag recess connected to, and extending from, a wire channel; and the groove being dimensioned to closely fit around the flag assembly comprises at least the flag recess being dimensioned to closely fit around the flag. The method then further comprises the step of forming the groove across the seal screw threads wherein the groove is circumferentially located such that one external seal thread valley crosses the wire channel at a thread crossing location that is approximately in the center of a long dimension of the wire channel.

According to the invention, a flag assembly for an electric lamp, comprises: a wire in a close-fitted electrically non-conductive sleeve; an outer end comprising a flag, formed from flat metal stock that is electrically and mechanically connected to the wire; a shank portion where the flat metal stock overlaps the wire, is conformed to the shape of the wire, and is covered by the sleeve; and a thickened portion that is positioned in the vicinity of a fold that traverses the flag from one lateral flag edge to the other lateral edge.

Further according to the invention, the flag assembly is such that the thickened portion traversingly extends to at least one of the lateral edges of the flag. Preferably the thickened portion comprises an extended end of the wire that is formed such that the extended end traverses a flat side of the flag; the thickened portion extends under the sleeve enough to increase the magnitude of a sleeve covered flag thickness, and the thickened portion extends out to the fold such that the fold is able to bend around the outer end of the thickened portion.

Further according to the invention, the flag assembly is such that the wire is electrically connected to at least one of one or more lead wires of the lamp; and the flag is bent over a lip of a base of the lamp, and is welded to an outside surface of the base.

Further according to the invention, the flag assembly is such that the electrically nonconductive sleeve comprises a resilient, high temperature material; and the flat metal stock comprises nickel ribbon. Preferably the sleeve comprises PTFE shrink tubing.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications, e.g., a tire 109 having a static imbalance versus a different tire 109' of the same design, but having a couple imbalance. Such relationships, if any, between similar elements in the same or different figures will become apparent throughout the specification, including, if applicable, in the claims and abstract.

Figure 1:
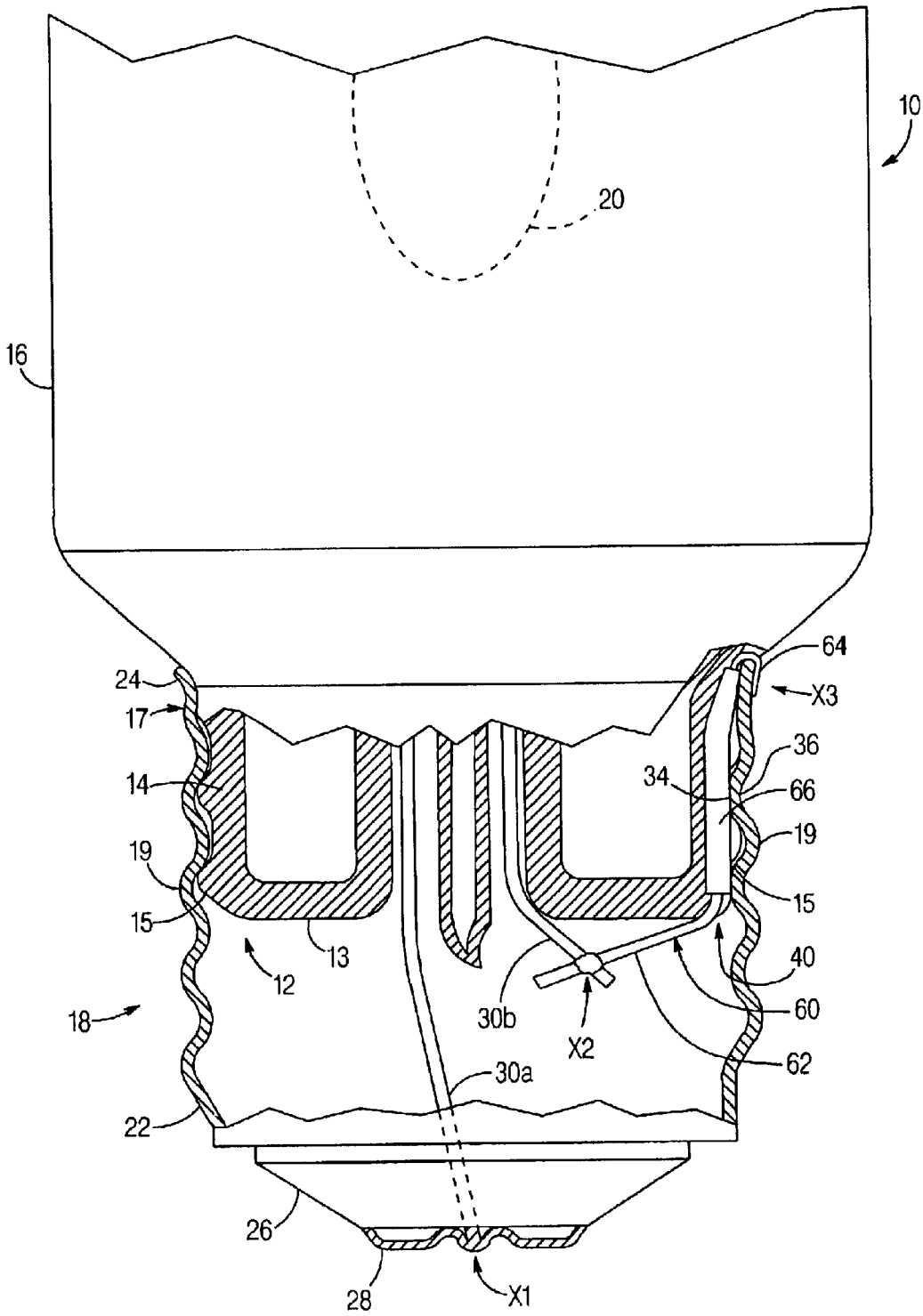
Figure 2:
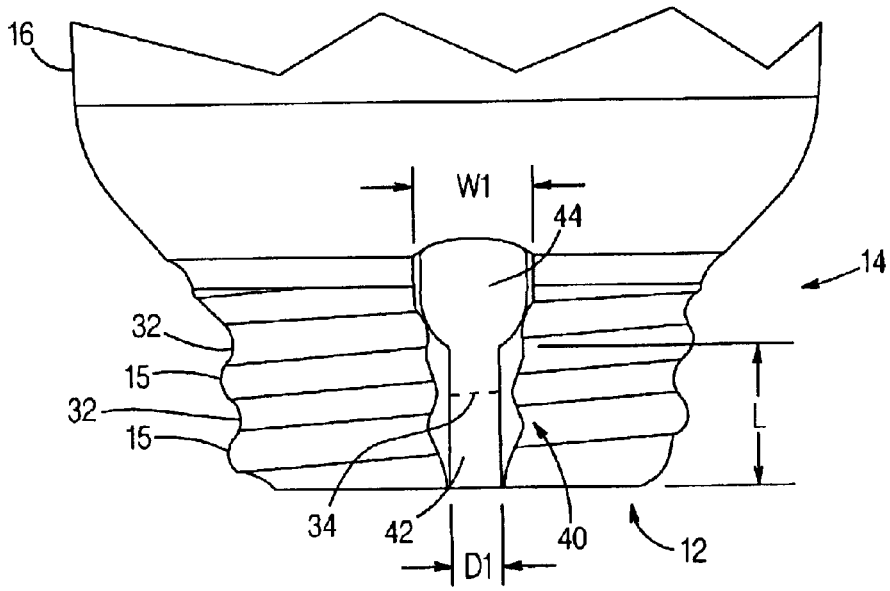
Figure 3:
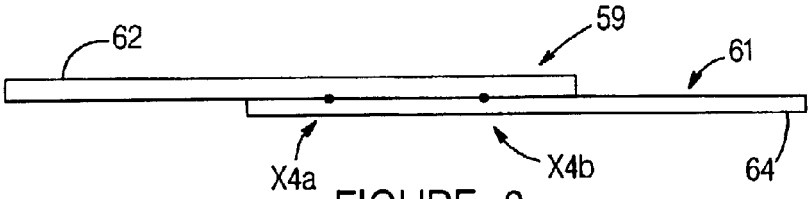
Figure 4:
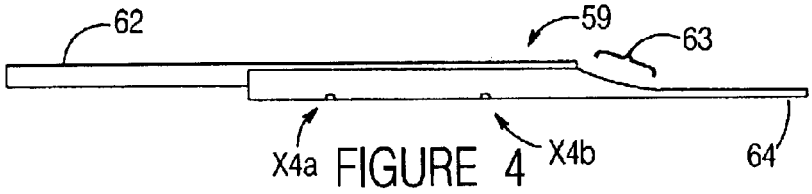
Figure 4A:
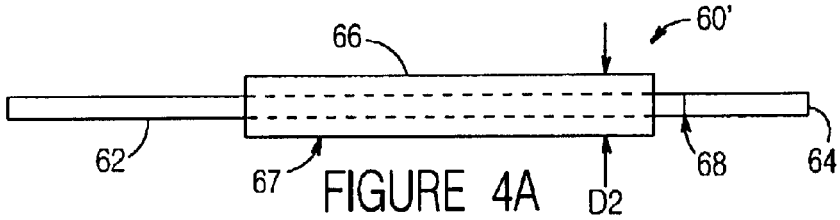
Figure 4B:
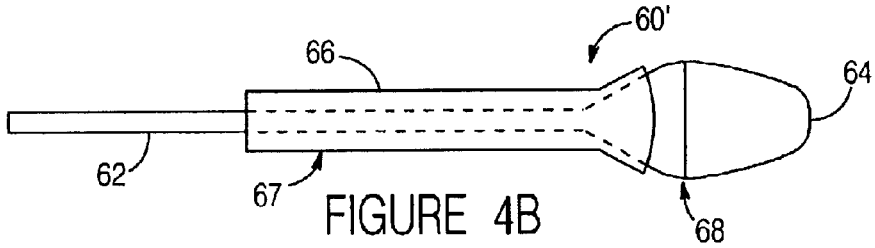
Figure 5:
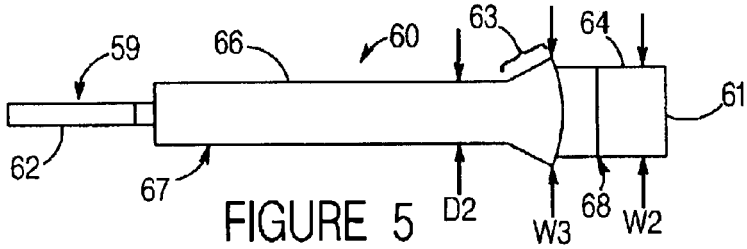
Figure 6:
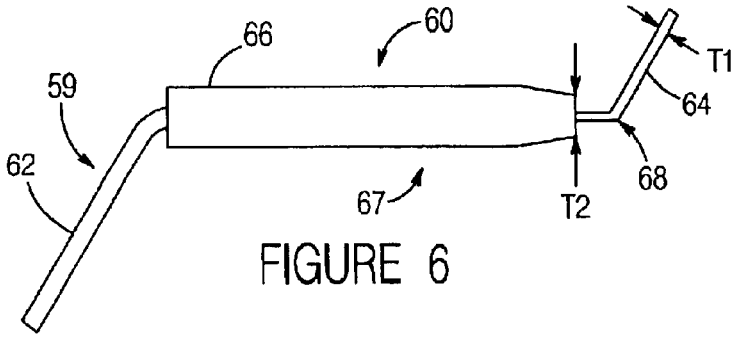
Figure 7:
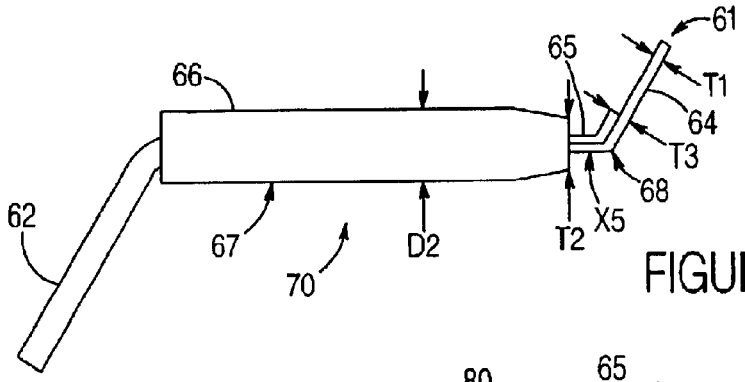
Figure 8:
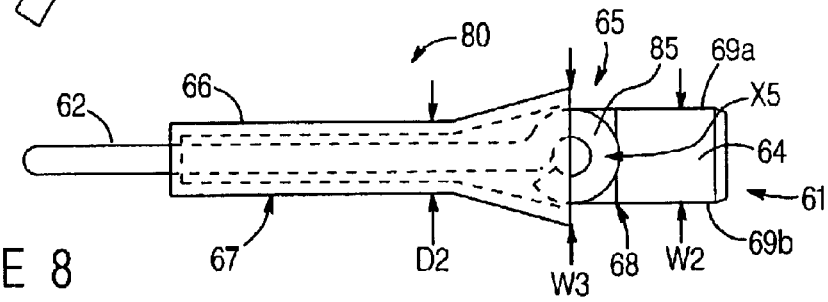
Figure 9:
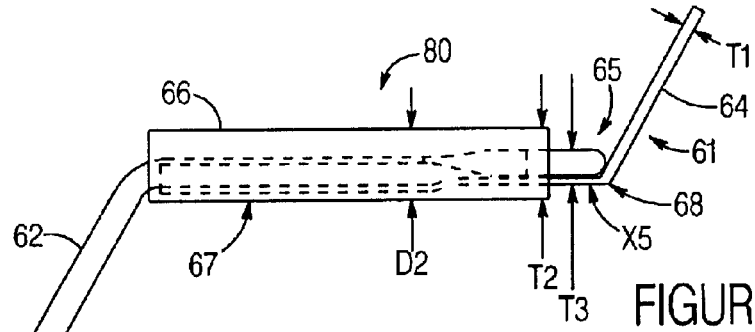
Figure 10:
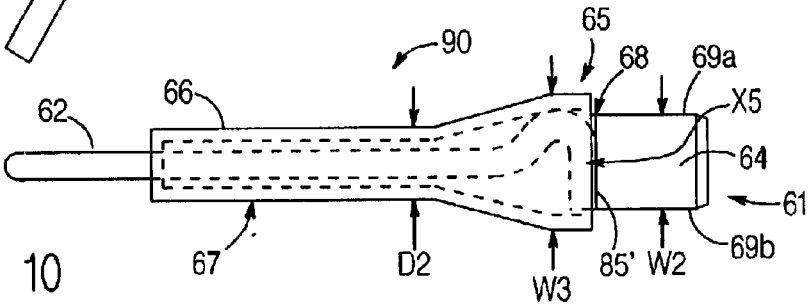
Figure 11:
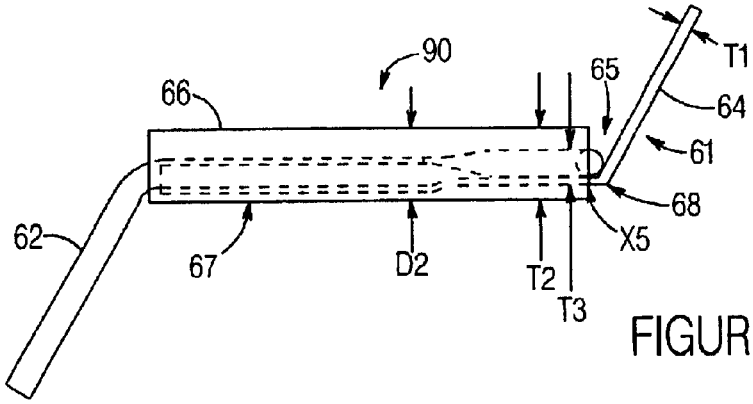

The structure, operation, and advantages of the present preferred embodiment of the invention will become further apparent upon consideration of the following description taken in conjunction with the accompanying drawings, wherein:

FIG. 1 is a side view, partly cut away to a cross-sectional view of a threaded seal and base portion, of a lamp assembly according to the invention;

FIG. 2 is a side view of a groove in the threaded seal, according to the invention;

FIG. 3 is a side view of a subassembly of a flag assembly, according to the invention;

FIG. 4 is a side view of the flag subassembly of FIG. 3, after forming a length of flat metal stock around a wire, according to the invention;

FIG. 4A is a side view of a simplified embodiment of the flag assembly, according to the invention;

FIG. 4B is a top view of the flag assembly of FIG. 4A, after forming the wire into a flattened flag portion, according to the invention;

FIG. 5 is a side view of a first preferred embodiment of the flag assembly, according to the invention;

FIG. 6 is a top view of the flag assembly of FIG. 5, according to the invention;

FIG. 7 is a side view of a first alternate embodiment of the flag assembly, according to the invention;

FIG. 8 is a top view of a second alternate embodiment of the flag assembly, according to the invention;

FIG. 9 is a side view of the flag assembly of FIG. 8, according to the invention;

FIG. 10 is a top view of a second preferred embodiment of the flag assembly, according to the invention; and FIG. 11 is a side view of the flag assembly of FIG. 10, according to the invention.

DETAILED DESCRIPTION OF THE INVENTION

A preferred embodiment of the present invention will now be described. For those skilled in relevant lampmaking arts it will become apparent that various aspects of the invention may have utility in other lampmaking applications, and all such embodiments of the invention, in whole or in part, are intended to be within the scope of the invention.

Referring first to FIG. 1, the present invention will be described as embodied in a high intensity discharge (HID) lamp 10 that incorporates a threaded seal 12 and a metal screw base (base 18) that is applied during lamp assembly by screwing it onto the threaded seal 12. The lamp 10 has a light source 20 contained in a protective outer jacket 16 (bulb) generally made of glass. HID lamps can produce a great deal of heat during operation, and have relatively long lifetimes (many thousands of hours), thereby requiring the use of bases 18 that will remain secured to the lamp 10 at the end of life so that the lamp 10 can be removed from its socket. Furthermore, the jacket 16 may be relatively large, thereby allowing a significant amount of torque to be applied by a customer when the lamp 10 is installed or removed from its socket. A lamp 10 that is loose in its socket due to movement of the jacket 16 relative to the base 18 raises questions about lamp quality at the least, and may cause problems of alignment between the lamp and a fixture and reflector in which it is installed. Of course, if the base 18 is so loose that it allows many degrees of relative circumferential movement, then electrical lead wires 30*a*, 30*b* may cross, and/or the base 18 may separate from the jacket 16 making removal of the base 18 from the socket difficult as well as failing to hold the lamp 10 in the socket. Therefore, the base 18 must be secured to the lamp 10 in a way that restricts movement of the jacket 16 relative to the base 18, even under conditions of high torque, and even after a long period of exposure to high temperature heating and possibly other extreme environmental conditions. The present invention provides means for meeting such stringent conditions without using either solder or adhesive as have been used in the prior art. Although the preferred embodiment of the present invention uses resistance welding as described hereinbelow, it should be apparent that other forms of welding could also be used to implement some or all of the aspects of the present invention.

FIG. 1 illustrates a partially cut away side view of a portion of a lamp 10 that incorporates a generalized embodiment of the present invention. The outer jacket 16 is made of glass that is necked down and sealed in the portion that will be contained in the screw-threaded base 18. A neck portion 14 of the jacket 16 is formed during sealing with screw threads 15 and with a groove 40 (best seen in FIG. 2) that will be described in detail hereinbelow. The seal screw threads 15 form a threaded seal 12 that mates with base screw threads 19 in a shell portion 22 of the base 18. The base 18 is generally comprised of a threaded shell 22 made of metal, preferably brass that may be nickel plated, an insulator 26, preferably ceramic, and a metal eyelet 28, also preferably brass. The insulator 26 and eyelet 28 fill one end of the base 18, a "bottom" end. The open top end of the base 18 has a circumferential lip 24 that may be angled slightly outward. When the base 18 is applied to the lamp 10, the base 18 is generally screwed onto the threaded seal 12 until the lip 24 stops against the outer jacket 16, thereby jamming the base threads 19 against the seal threads 15 to prevent wobbling of the base 18. However, the base 18 must be prevented from unscrewing in order to complete the securing of the base 18 on the lamp 10.

The lamp 10 has two lead wires 30*a*,30*b* (collectively referred to as 30) extending out of a bottom 13 of the seal 12. The lead wires 30 are generally connected to the light source 20 for providing electrical power to the light source 20. A first lead wire 30*a* is electrically connected to the eyelet 28 by means of a weld X1, and a second lead wire 30*b* is electrically connected to the shell 22 by means of a flag assembly 60. In its simplest form, the flag assembly 60 could be an extension of the second lead wire 30*b* with a portion covered by a sleeve 66. In a first preferred embodiment of the invention, the flag assembly 60 is a distinct assembly that is electrically connected at one end to the second lead wire 30*b*, preferably by a crossed-wire resistance weld X2; and electrically connected at the other end to the shell 18, preferably by a resistance weld X3. The first preferred embodiment of the flag assembly 60 is described in more detail hereinbelow with reference to FIGS. 3, 4, 4A, 4B, 5, and 6 (FIGS. 3–6).

After forming the threaded seal 12 having the groove 40, and after forming a flag assembly 60, assembly of the lamp 10 preferably includes the following steps:

a) welding a wire 62 of the flag assembly 60 to the second lead wire 30*b;*
b) positioning the flag assembly 60 in the groove 40 such that a flag 64, forming an outer end of the flag assembly 60, is positioned to be bent over the lip 24;
c) screwing the base 18 onto the seal threads 15 until the lip 24 stops against the outer jacket 16;
d) bending the flag 64 over the lip 24; and
e) welding the flag 64 to an outside surface 17 of the base 18, preferably close to the lip 24.

FIG. 2 is a side view of the neck 14 of the jacket 16. The groove 40 is formed across the seal threads 15 and comprises two connected portions, a channel 42 and a flag recess 44 extending from the channel 42; and the two connected portions 42, 44 are dimensioned to closely fit around mating portions of the flag assembly 60. As best viewed in FIGS. 5 and 6, the flag assembly 60 comprises a wire 62, preferably round in cross-section, a substantially round shank 67 having a diameter D2, and a flag 64 made from flat metal stock 61 having a width W2 and a thickness T1. A fold 68 is formed transversally, preferably orthogonally, across the flag 64. The shank 67 comprises a sleeve 66 made of an electrically insulating (electrically nonconductive), preferably resilient, tubular material that is shrinkfit around a portion of the wire 62, a portion of the flag 64, and a portion where the flat stock 61 and wire 62 overlap. Thus the wall thickness (after shrinkfitting) of the sleeve 66 contributes to the shank diameter D2, to a sleeve covered flag thickness T2, and to a sleeve covered flag width W3.

The groove 40 is dimensioned such that the groove 40 closely fits around the flag assembly 60; i.e., the wire channel 42 closely fits around the shank 67, and the flag recess 44 closely fits around the sleeve covered flag 64. It should be understood that the "close fit" must apply when the base 18 has been screwed onto the threaded seal 12 as shown in FIG. 1 wherein the screw threads 19 and the lip 24 of the base 18 define outer limits for the space that confines the flag assembly 60 in the groove 40 and between the seal 12 and the base 18. For example, a preferred embodiment of the invention utilizes the following exemplary dimensions. The channel 42 has a roughly half-round bottom of diameter D1 that closely matches the diameter D2 of the shank (e.g., channel diameter D1 is approximately 2.8 mm and shank diameter D2 is approximately 2.2 mm). It should be noted that what appears to be free space between the shank 67 and the channel 42 is actually filled when the base 18 is screwed onto the threaded seal 12 because the screw threads 19 radially compress portions of the sleeve 66 thereby causing it to expand laterally to fill the available space in the channel 42. This is an example of a reason for preferring the use of a resilient material for the sleeve 66. The flag recess 44 has a substantially flat bottom of width W1 that closely matches the width W3 of the flag 64 covered by the sleeve 66 (e.g., recess bottom width W1 is approximately 3.5 mm, flag width W2 is approximately 3.0 mm, and sleeved flag width W3 is approximately 3.8 mm). In order to minimize glass stress and to allow repeatable glass forming, the sides on the groove 40 in both the channel 42 and the recess 44 are slightly beveled (e.g., a 10° outward opening angle on each side). The depth of the channel 42, being measured from the bottom of the half-round portion to the innermost surface of the base threads 19 after the base 18 is screwed onto the threaded seal 12, is approximately equal to or slightly less than the diameter D2 of the shank 67. The recess 44 varies in depth to accommodate the transition from the shank diameter D1 to the sleeve covered flag thickness T2. The recess 44 has the least depth where it passes under the lip 24 of the base 18, and this least depth is approximately equal to the sleeve covered flag thickness T2 (e.g., flag thickness T1 is nominally 0.25 mm, and the sleeve adds two times its wall thickness after shrinkfitting, or approximately 0.8 mm). In order to allow the flag 64 to wrap around the lip 24, the flag recess 44 extends beyond the lip 24 (see FIG. 1) a distance of at least the flag thickness T1 at the point of the fold 68. As noted above, the shank 67 of the flag assembly 60 has a certain amount of resiliency due to the sleeve 66 and may therefore be compressed within the groove 40, and between the groove 40 and the base 18 in order to obtain the closest possible fit. Similarly, the resilient sleeve 66 partially covering the flag 64 may be compressed within the flag recess 44, and between the flag recess 44 and the base 18 in order to obtain the closest possible fit.

As can be seen from the side view of FIG. 2, the seal threads 15 cross the wire channel 42 of the groove 40 at certain locations along the long dimension L of the wire channel 42 (e.g., a thread crossing location 34). Because the seal threads 15 spiral around the circumference of the neck 14, the circumferential location of the groove 40 on the threaded seal 12 will determine the exact location of the thread crossings (e.g., 34). Referring to both FIGS. 1 and 2, the significance of the thread crossings can be seen in that the base threads 19 have internal peaks 36 that threadingly mate with external valleys 32 of the seal threads 15, and the base thread internal peaks 36 will contact and press into the sleeve 66 at the thread crossings (e.g., 34). To help prevent shifting of the flag assembly while the base 18 is being screwed onto the threaded seal 12, the groove 40 is preferably circumferentially located such that one thread valley 32 crosses the wire channel 42 at a thread crossing location 34 that is approximately in the center of the long dimension L of the wire channel 42.

From the foregoing description it should be apparent that, according to the invention, the groove 40 is dimensioned to limit as much as possible any circumferential movement of the flag assembly 60 in a finished lamp 10. Since the flag assembly 60 is welded to the base 18, circumferential torque on the base 18 translates into forces on the flag 64 that must be resisted by the flag recess 44, therefore the relative dimensions of the flag 64, any additions to the flag 64 (e.g., the sleeve 66), and the flag recess 44 are important features of the invention. Because of their role in helping to hold the entire flag assembly 60 in position, and also because of the support they provide to the base shell 22 during welding, the relative dimensions of the shank 67 and the channel 42 are also important features of the invention. However, it is noted that the flag 64 and the flag recess 44 may be the most important features relative to securing the base 18 on the lamp, therefore it is within the scope of the invention for close fitting of the groove 40 to the flag assembly 60 to comprise close fitting of the flag recess 44 to the flag 64, preferably including a portion of the flag 64 that is covered by the sleeve 66.

One skilled in the relevant arts may recognize that torque on the base 18 of a finished lamp will generate many different force vectors for the flag assembly 60. For example, in addition to circumferentially directed force that would cause the flag 64 to push against the lateral edges of the flag recess, force moments may attempt to twist or buckle the flat, relatively thin flag 64. A flag cavity 44 depth that closely fits flag thicknesses T1, T2 helps in controlling such movements, and alternate embodiments of the flag assembly 60 design can be used to further address these problems as needed.

The first preferred embodiment of the flag assembly 60 will now be described with particular reference to FIGS. 3–6. Prior art attempts to secure the base 18 to the lamp 10 without using solder or adhesive generally comprised bending the lead wire 30*b* around the lip 24 and welding it to the outside surface 17 of the base 18. To restrict circumferential movement, the groove 40 was reduced in channel diameter D1 in an attempt to closely fit the groove 40 to the lead wire 30*b*. The lead wire 30*b* is typically monel wire having a nominal diameter of only 0.9 mm, and it is very difficult to reliably form a stress-free groove 40 of such a small dimension in glass. Therefore, a simple embodiment of the present invention would be to cover part of the length of the lead wire 30*b* with a sleeve 66 to form a flag assembly 60' (FIG. 4A) wherein both the wire 62 and the flag 64 of the flag assembly are made of the same wire material, preferably the lead wire 30*b*. Adding the sleeve 66 has the effect of increasing the diameter D2 of the shank 67, thereby allowing a better-dimensioned close fitting groove 40. Early attempts at this design used a stainless steel tube for the sleeve 66, but this is difficult to make with thick enough walls to get a desirable shank diameter D2. Furthermore, it was determined that a resilient, electrically insulating sleeve 66 would provide added benefits: the resilient material could be shrinkfit around the wire 62 and is available with suitable outside diameters D2 the resilient material can be compressed to fit more closely in the groove 40, adapting to dimensional variation that is common in glass forming; and the resilient, electrically insulating sleeve 66 would provide non-shunting backup support for the resistance weld X3 of the flag 64 to the base shell 22.

As taught in the Thiry patent disclosed in the Background hereinabove, backup support is important to attaining a high percentage of good quality resistance welds such as the welds X3 on the side of the base shell 22. It is also known in the welding arts that unintentionally providing alternate paths for resistance welding current to be "shunted" around the welding point can cause welding defects. Referring to FIG. 1, for the resistance weld X3, a relatively small first welding electrode (not shown) is pressed against the flag 64 after it is bent over the lip 24, thereby forcing the flag 64 into contact with the outside surface 17 of the base shell 22. A relatively large second welding electrode is pressed directly against the base shell 22, and then a very large electric current is caused to flow between the two welding electrodes. The current causes heating of all points in the electrical path (or paths) along which the current flows, and the heating is directly proportional to the electrical resistance at each point of the path. (The heating is also directly proportional to the square of the current.) Generally speaking, the welding system is designed so that the electrical resistance is highest where the current flows through a contact area where the flag 64 contacts the outside surface 17 of the base shell 22. Thus the highest amount of heat is generated at the desired welding point, and the current is controlled to produce enough heat to melt the flag 64 and the shell 22 together. Either too much or too little heat can result in a defective weld X3. Variable support behind the weld point can produce variable resistance at the weld point, thereby varying the amount of heating such that defective welds are produced.

Furthermore, if the flag assembly 60, 60' (for example the flag 64) is allowed to touch the inside of the base shell 22, then the welding current can divide into two paths—one path from the first electrode through the flag 64 to the outside surface 17 of the shell 22 at the weld point; and a second path from the first electrode through the flag 64 to the inside surface of the shell 22, thereby shunted around the weld point. The shunting reduces the current, and therefore the heating, at the weld point, likely causing a defective weld or even no weld. If such a shunt path had the same resistance in each lamp 10 being welded, then the welding current could be adjusted upward to compensate. However, this shunting effect is more likely to be quite variable since it depends on many uncontrollable factors such as the area of contact and the contact pressure between the flag 64 and the inside surface of the base shell 22. Consequently, an objective of the present invention to achieve good weld quality is implemented by electrically insulating the flag assembly 60, 60' at the most likely potential points of contact between the flag assembly 60, 60' and the base 18 (other than the location of the weld X3 itself). Therefore the sleeve 66 is preferably made of an electrically insulating material. It can be seen that the flag assembly (e.g., 60, 60') according to the present invention could be used as a welding aid in any lamp 10 wherein the lead wire 30 to base shell 22 connection is to be made by means of a resistance weld X3, regardless of the type of base 18 (e.g., bayonet or screw-threaded), regardless of the means of securing the base 18 on the lamp 10 (e.g., could be a non-threaded seal, with or without a groove 40, and adhesive could be used to secure the base 18 to the seal).

The flag assembly 60, 60' could use any type of electrically insulating, preferably resilient, material for the sleeve 66 (e.g., rubber tubing, plastic shrink tubing) if it was being used simply to provide a shank 67 that fills the groove 40 for securing the base 18 to the lamp 10. However, in order to resist the heat of the resistance weld X3, the sleeve 66 is preferably made of a high temperature resilient material such as PTFE (ploytetrafluoroethylene), generally available under the trade name of Teflon™. For ease of assembly while assuring a close fit of the sleeve 66 on the flag assembly, the sleeve 66 is preferably made of PTFE shrink tubing. For example, the PTFE shrink tubing has an expanded inside diameter of approximately 1.93 mm versus a wire diameter of 0.9 mm, and has a shrink ratio of two to one.

In order to limit circumferential movement of the base 18, the flag 64 portion of the flag assembly 60, 60' is preferably stiffened, however such stiffening may conflict with the need to form a fold 68 to bend the flag over the lip 24. A preferred method for stiffening the flag 64 in the lateral direction but not in the bending direction is to shape the flag 64 as a flat portion. A simple embodiment of this can be provided by flattening the wire in the flag 64 portion of the flag assembly 60' as illustrated in FIG. 4B. Since flattening a wire generally causes work hardening that stiffens the flag 64 in the fold 68, annealing is desirable after flattening.

A first preferred embodiment of the flag assembly 60 is illustrated in FIGS. 5 (top view) and 6 (side view), with reference to flag subassembly 59 drawings in FIGS. 3 and 4. The flag 64 portion of the flag assembly 60 is preferably a piece of metal flat stock 61, e.g., nickel ribbon stock nominally dimensioned with a thickness T1 of approximately 0.25 mm, and a width W2 of approximately 3 mm. Nickel is the preferred material for the flag 64 because it provides good weldability for welding the flag 64 to the wire 62 and also to the base 18, however the invention is not limited to any particular choice of materials. As shown in FIG. 3, a flag subassembly 59 is manufactured by electrically and mechanically attaching a cut length of the flat stock 61 used for the flag 64 to the wire 62, thereby electrically and mechanically connecting the flag 64 to the wire 62. As noted hereinabove, the wire 62 can be one of the lamp lead wires 30 or the wire 62 can be a separate piece of wire stock. As shown in FIG. 4, the flat stock 61 is formed around the wire 62, transitioning in a transition zone 63 to a flat flag 64 beyond the wire 62. For simplicity of illustration, the transition zone 63 is illustrated with a flat underside. As those skilled in metal forming arts will recognize, the transition zone 63 will likely be much more complex in shape, such that the backside generally angles up to the right to minimize stretching of the flat stock 61 along the lateral edges. All suitable shapes of the transition zone 63 and the flag 64 are intended to be within the scope of the present invention. As shown in FIGS. 5 and 6, the flag assembly 60 is formed by sliding the sleeve 66 over the shank 67 portion of the flag subassembly 59 and then heat shrinking the sleeve 66 into place. The forming of the flat stock 61 around the wire 62 can be implemented by any method that will allow the sleeve 66 to be fitted onto the flag subassembly 59 to form the shank 67 such that it will closely fit into the groove 40 according to the invention. For example, the flat stock 61 can be pre-formed into a U-shaped channel that fits at least partially around the wire 62. For example, the flat stock 61 can be wrapped entirely around the wire 62. For example, a suitable length of the flat stock 61 can be cut or folded to a width approximately equal to the diameter of the wire 64. Likewise, the method of electrically and mechanically attaching the flat stock 61 to the wire 62 is not to be limited to any one technique, but is preferably implemented by means of resistance welding that forms one or more spot welds X4, e.g., welds X4*a* and X4*b*.

As discussed hereinabove, the sleeve 66 is preferably PTFE shrink tubing that has, for example, an expanded inside diameter of approximately 1.93 mm. This easily fits over a wire diameter of 0.9 mm plus twice the 0.25 mm thickness of the flag 64 material for an outside diameter of 1.4 mm for the flag subassembly 59. The sleeve 66 is resilient enough to allow it to be stretched over the flag width W2, thereby allowing the sleeve 66 in the completed flag assembly 60 to extend at least partly over the flag 64. It is within the scope of the invention for the sleeve 66 to extend over the flag 64 beyond the fold 68 and up to the point where the flag-to-shell weld X3 is to be made. Preferably the sleeve 66 extends just over the transition zone 63, ending close to the fold 68 as shown in FIGS. 5 and 6, for example.

As best seen in FIG. 6, the flag assembly 60 is preferably pre-formed in order to simplify its assembly in the lamp 10 (shown after assembly in FIG. 1). A fold 68 is formed transversally, preferably orthogonally, across the flag 64 so that the flag assembly 60 can be positioned in the groove 40 with the flag 64 extending out of the flag recess 44 immediately above the lip 24 of the base 18. The angle of the fold 68 is preferably at least the same as the angle of a top surface of the flag recess 44, and is optionally a compound bend that folds around enough to form a hook (not shown) that catches on the lip 24 to push the flag assembly 60 into position in the groove 40 as the base 18 is threaded onto the threaded seal 12. The hook formation of the flag 64 also pre-positions the flag above the base outside surface 17 where it is to be welded. The wire 62 is preferably bent toward the radial center of the threaded seal 12 so that the wire 62 can be cross-wire welded (e.g., weld X2) to a lead wire 30*b*.

FIGS. 7, 8, 9, 10 and 11 (FIGS. 7–11) illustrate flag assemblies 70, 80, 90 that are within the scope of the present invention and form alternate embodiments of the flag assembly 60, such that any of the flag assemblies 70, 80, 90 may form a preferred embodiment of the invention when substituted for the flag assembly 60 and assembled in the groove 40 as shown in FIG. 1. All of the flag assemblies 60, 60', 70, 80, 90 described herein are to be considered as examples that embody the teachings of the present invention, and should not be construed as limiting the scope of the claims to this invention. As described hereinabove, a feature of the invention is a thickness T2 of the flag assembly 60 sufficient to cause the lateral sides of the flag assembly 60 to jam against the lateral sides of the groove 40, especially the flag recess 44 portion of the groove 40, thereby securing the base 18 on the lamp 10 by resisting circumferential torque on the base 18 that is welded to the flag 64. Furthermore, a desirable characteristic of the flag assembly 60 of the invention is rigidity in the lateral direction (i.e., tangential to the circumference of the lip 24 of the base shell 22) while still allowing enough flexibility to allow the fold 68 to be formed so that the flag 64 can be bent over the lip 24.

A first alternate embodiment of the invention incorporates alternate flag assembly 70 as illustrated in FIG. 7. Like the flag assembly 60, the flag 64 is electrically and mechanically connected to the wire 62 and covered by the sleeve 66 to form the shank 67 that has a diameter D2 for close-fitting into the wire channel 42 of the groove 40. A distinctive feature of the alternate flag assembly 70 is a thickened portion 65 of the flag 64 that is positioned in the vicinity of the fold 68 in order to provide extra rigidity to the flag 64 and/or to increase the sleeve covered flag thickness T2. For example, an extra piece of flat metal stock can be welded (e.g., weld X5) to the flat metal stock 61 used for the flag 64. For example, the thickened portion 65 can overlap the fold 68, as shown, but could also have many other configurations that achieve the objective of increasing flag rigidity and thickness. Preferably, the thickened portion 65 extends under the sleeve 66 enough to increase the magnitude of the sleeve covered flag thickness T2. Where the sleeve 66 does not cover the flag 64, the flag thickness T1 is increased to a thickened portion flag thickness T3 in the region of the thickened portion 65.

A second alternate embodiment of the invention incorporates alternate flag assembly 80 as illustrated in FIG. 8 (top view) and FIG. 9 (side view). Like the flag assembly 60, the flag 64 is electrically and mechanically connected to the wire 62 and covered by the sleeve 66 to form the shank 67 that has a diameter D2 for close-fitting into the wire channel 42 of the groove 40. A distinctive feature of the alternate flag assembly 80 is a thickened portion 65 of the flag 64 that is positioned in the vicinity of the fold 68 in order to provide extra rigidity to the flag 64 and to increase the thickness T2. The thickened portion 65 preferably comprises an extended end 85 of the wire 62 that is formed such that the extended end 85 traverses the flat side of the flag 64, extending to one, or preferably both lateral edges 69*a*, 69*b* of the flag 64 to match the flag width W2. For example, the extended end 85 is formed into a loop 85 as shown in FIG. 8, the loop 85 preferably having an outside diameter equal to the flag width W2. The extended end 85 (e.g., loop 85) is positioned such that the thickened portion 65 extends under the sleeve 66 enough to increase the magnitude of the sleeve covered flag thickness T2, and preferably extends out to the fold 68 such that the fold 68 is able to bend around the outer end of the extended end 85, i.e., the outer end of the thickened portion 65. Where the sleeve 66 does not cover the flag 64, the flag thickness T1 is increased to a thickened portion flag thickness T3 in the region of the thickened portion 65. Preferably the extended end 85 is welded (e.g., one or more welds X5) to the flat metal stock 61 used for the flag 64. It may be noted that the one or more welds X5 could be used as the primary means of electrically and mechanically connecting the flag 64 to the wire 62, thereby eliminating the need for other welds such as the welds X4*a*, X4*b* illustrated in FIGS. 3 and 4. Given the description of the flag assembly 80, it should be apparent that the extended end 85 can be formed in a great variety of shapes, all of which should be within the scope of the present invention. For example, the extended end 85 could be a triangular loop (not illustrated), with a flat side against the fold 68. For example, the extended end 85 could be T-shaped with the top of the T against the fold 68. It should also be apparent that the extended end 85 does not have to extend exactly to both lateral edges 69*a*, 69*b* of the flag 64 thus matching the flag width W2. For example, the extended end 85 can extend beyond one or both lateral edges 69*a*, 69*b* of the flag 64, thereby defining a flag width W2 that is greater than the width of the flat stock 61 used to make the flag 64. For example, the extended end 85 can extend to only one lateral edge 69*a*, 69*b* of the flag 64, e.g., the lateral edge 69*a*, 69*b* that would jam against the lateral side of the flag recess 44 when circumferential torque is applied to the base 18 in an un-screwing direction.

A third alternate embodiment of the invention, presently envisioned as a most preferred embodiment, incorporates alternate flag assembly 90 as illustrated in FIG. 10 (top view) and FIG. 11 (side view). Like the flag assembly 60, the flag 64 is electrically and mechanically connected to the wire 62 and covered by the sleeve 66 to form the shank 67 that has a diameter D2 for close-fitting into the wire channel 42 of the groove 40. A distinctive feature of the alternate flag assembly 90 is a thickened portion 65 of the flag 64 that is positioned in the vicinity of the fold 68 in order to provide extra rigidity to the flag 64 and to increase the thickness T2. The thickened portion 65 preferably comprises an extended end 85' of the wire 62 that is formed such that the extended end 85' traverses the flat side of the flag 64, extending to one, or preferably both lateral edges 69*a*, 69*b* of the flag 64 to match the flag width W2. For example, the extended end 85' is formed into an L-shaped hook 85' as shown in FIG. 10, the hook 85' preferably having a lateral extent equal to the flag width W2. The extended end 85' (e.g., hook 85') is positioned such that the thickened portion 65 extends under the sleeve 66 enough to increase the magnitude of the sleeve covered flag thickness T2, and preferably extends out to the fold 68 such that the fold 68 is able to bend around the outer end of the extended end 85', i.e., the outer end of the thickened portion 65. In FIGS. 10 and 11, the sleeve 66 is shown extending substantially out to the fold 68, thereby substantially covering and insulating the flag 64 as well as the wire 62 wherever they will be positioned under the base 18. This is a preferred extent for the sleeve 66. The flag thickness T1 is increased to a thickened portion flag thickness T3 in the region of the thickened portion 65. Preferably the extended end 85' is welded (e.g., one or more welds X5) to the flat metal stock 61 used for the flag 64. It may be noted that the one or more welds X5 could be used as the primary means of electrically and mechanically connecting the flag 64 to the wire 62, thereby eliminating the need for other welds such as the welds X4*a*, X4*b* illustrated in FIGS. 3 and 4. It should be apparent that the extended end 85' does not have to extend exactly to both lateral edges 69*a*, 69*b* of the flag 64 thus matching the flag width W2. For example, the extended end 85' can extend beyond one or both lateral edges 69*a*, 69*b* of the flag 64, thereby defining a flag width W2 that is greater than the width of the flat stock 61 used to make the flag 64. For example, the extended end 85' can extend to only one lateral edge 69*a*, 69*b* of the flag 64, e.g., the lateral edge 69*a*, 69*b* that would jam against the lateral side of the flag recess 44 when circumferential torque is applied to the base 18 in an un-screwing direction.

A variety of embodiments of the present invention have been disclosed hereinabove. The invention has been described as a lamp assembly 10, and as a method for securing a base 18 on the lamp 10, both assembly and method being suitable for electrically connecting a side lead wire 30*b* to the base shell 22 and also for securing the base 18 to the lamp 10 without using either solder or adhesive. The invention is designed in a way that optimizes welding efficiency for the side lead wire to base shell connection.

The lamp assembly 10 according to the invention includes at least: a metal screw base 18 having base screw threads 19 for screwing into a socket and for establishing one or more electrical connections between the base 18 and the socket; an outer jacket 16 having a threaded seal 12 wherein seal screw threads 15 are formed in a neck portion 14 of the outer jacket 16, such that the seal screw threads 15 conform to the base screw threads 19 to allow the base 18 to be screwed onto the threaded seal 12; at least one lead wire 30 extending out of a bottom 13 of the seal 12; a flag assembly 60, 60', 70, 80, 90 for electrically connecting a lead wire 30 to a shell 22 of the base 18, the flag assembly 60, 60', 70, 80, 90 comprising a wire 62 in a close-fitted electrically nonconductive sleeve 66; a groove 40 formed across the seal screw threads 15 and dimensioned to closely fit around the flag assembly 60, 60', 70, 80, 90; and the flag assembly 60, 60', 70, 80, 90 being positioned in the groove 40 such that an inner end 62 of the flag assembly 60, 60', 70, 80, 90 is electrically connected to the lead wire 30, and an outer, flag, end 64 of the flag assembly 60, 60', 70, 80, 90 is bent over a lip 24 of the base 18 and welded to an outside surface 17 of the base 18, with the weld X3 preferably being near to the lip 24.

A method for securing the base 18 on the lamp 10 includes at least the following steps:

a) forming seal screw threads 15 in a neck portion 14 of an outer jacket 16 of the lamp 10 such that the seal screw threads 15 conform to base screw threads 19 of the base 18;
b) providing a flag assembly 60, 60', 70, 80, 90 comprising a wire 62 in a close-fitted electrically nonconductive sleeve 66;
c) forming a groove 40 across the seal screw threads 15 wherein the groove 40 is dimensioned to closely fit around the flag assembly 60, 60', 70, 80, 90;
d) positioning the flag assembly 60, 60', 70, 80, 90 in the groove 40;
e) screwing the base 18 onto the seal screw threads 15;
f) bending an outer end 64 of the flag assembly 60, 60', 70, 80, 90 over a lip 24 of the base 18; and
g) welding the outer end 64 of the flag assembly 60, 60', 70, 80, 90 to an outside surface 17 of the base 18.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A lamp assembly comprising:

a metal screw base having base screw threads;

an outer jacket having a threaded seal wherein seal screw threads are formed in a neck portion of the outer jacket, such that the seal screw threads conform to the base screw threads to allow the base to be screwed onto the threaded seal;

one or more lead wires extending out of a bottom of the threaded seal;

a flag assembly comprising a wire in a close-fitted electrically nonconductive sleeve, the flag assembly having an outer end comprising a flag;

a groove formed across the seal screw threads and dimensioned to closely fit around the flag assembly; and the flag assembly being positioned in the groove such that an inner end of the flag assembly is electrically connected to at least one of the one or more lead wires, and the flag of the flag assembly is bent over a lip of the screw base and welded to an outside surface of the screw base.

2. The lamp assembly of claim 1, wherein:

the wire of the flag assembly is at least one of the one or more lead wires.

3. The lamp assembly of claim 1, wherein:

the inner end of the flag assembly is electrically connected to at least one of the one or more lead wires by welding.

4. The lamp assembly of claim 1, wherein:

the flag comprises flat metal.

5. The lamp assembly of claim 4, wherein:

the flag is a separate piece of flat metal stock that is electrically and mechanically connected to the wire; and a shank portion of the flag assembly where the flat metal stock overlaps the wire is conformed to the shape of the wire and is covered by the sleeve.

6. The lamp assembly of claim 5, wherein:

the flag has a thickened portion that is positioned in the vicinity of a fold where the flag assembly is bent over the lip of the screw base.

7. The lamp assembly of claim 6, wherein:

the thickened portion traversingly extends to at least one of two lateral edges of the flag.

8. The lamp assembly of claim 7, wherein:

the thickened portion comprises an extended end of the wire that is formed such that the extended end traverses a flat side of the flag.

9. The lamp assembly of claim 7, wherein:

the thickened portion extends under the sleeve enough to increase the magnitude of a sleeve covered flag thickness.

10. The lamp assembly of claim 7, wherein:

the thickened portion extends out to the fold such that the fold is able to bend around the outer end of the thickened portion.

11. The lamp assembly of claim 1, wherein:

the flag assembly is welded to the outside surface of the screw base by means of resistance welding.

12. The lamp assembly of claim 1, wherein:

the sleeve comprises a resilient, high temperature material.

13. A method for securing a base on a lamp comprising the steps of:

forming seal screw threads in a neck portion of the lamp such that the seal screw threads conform to base screw threads of the base;

providing a flag assembly comprising a wire in a close-fitted electrically nonconductive sleeve, the flag assembly having an outer end comprising a flag;

forming a groove across the seal screw threads wherein the groove is dimensioned to closely fit around the flag assembly;

positioning the flag assembly in the groove;

screwing the base onto the seal screw threads;

bending the flag over a lip of the base; and welding the flag to an outside surface of the base.

14. The method of claim 13, further comprising the step of:

providing a flat metal portion for the flag wherein at least a part of the flat metal portion is covered by the sleeve.

15. The method of claim 14, further comprising the steps of:

providing the flat metal portion by electrically and mechanically connecting a piece of flat metal stock to the wire; and for a shank portion of the flag assembly where the flat metal stock overlaps the wire, conforming the flat metal stock to the shape of the wire and covering the shank portion by the sleeve.

16. The method of claim 15, further comprising the step of:

providing a thickened portion on the flag.

17. The method of claim 16, further comprising the step of:

providing the thickened portion by extending the wire; and forming an extended end on the wire such that the extended end traverses a flat side of the flag and extends to at least one of two lateral edges of the flag.

18. The method of claim 13, further comprising the step of:

using resistance welding to weld the flag to the outside surface of the base.

19. The method of claim 13, further comprising the step of:

electrically connecting at least one of one or more lead wires of the lamp to the base by electrically connecting an inner end of the flag assembly to at least one of the one or more lead wires.

20. The method of claim 19, further comprising the step of:

utilizing at least one of the one or more lead wires as the wire of the flag assembly.

21. The method of claim 13, wherein:

the groove comprises a flag recess connected to, and extending from, a wire channel; and the groove being dimensioned to closely fit around the flag assembly comprises at least the flag recess being dimensioned to closely fit around the flag.

22. The method of claim 21, further comprising the step of:

forming the groove across the seal screw threads wherein the groove is circumferentially located such that one external seal thread valley crosses the wire channel at a thread crossing location that is approximately in the center of a long dimension (L) of the wire channel.

23. A flag assembly for an electric lamp, comprising:

a wire in a close-fitted electrically nonconductive sleeve;

an outer end comprising a flag, formed from flat metal stock that is electrically and mechanically connected to the wire;

a shank portion where the flat metal stock overlaps the wire is conformed to the shape of the wire and is covered by the sleeve; and a thickened portion that is positioned in the vicinity of a fold that traverses the flag from one lateral flag edge to the other lateral edge.

24. The flag assembly of claim 23, wherein:

the thickened portion traversingly extends to at least one of the lateral edges of the flag.

25. The flag assembly of claim 24, wherein:

the thickened portion comprises an extended end of the wire that is formed such that the extended end traverses a flat side of the flag.

26. The flag assembly of claim 24, wherein:

the thickened portion extends under the sleeve enough to increase the magnitude of a sleeve covered flag thickness (T2).

27. The flag assembly of claim 24, wherein:

the thickened portion extends out to the fold such that the fold is able to bend around the outer end of the thickened portion.

28. The flag assembly of claim 23, wherein:

the wire is electrically connected to at least one of one or more lead wires of the lamp; and the flag is bent over a lip of a base of the lamp, and is welded to an outside surface of the base.

29. The flag assembly of claim 23, wherein:

the electrically nonconductive sleeve comprises a resilient, high temperature material; and the flat metal stock comprises nickel ribbon.

* * * * *